United States Patent [19]

Forti et al.

[11] Patent Number: 4,849,738

[45] **Date of Patent: * Jul. 18, 1989**

[54] ALARM OR WARNING SYSTEM FOR USE WITH AN OUTBOARD MOTOR

[76] Inventors: Steven A. Forti, 321 Winter St., Norwell, Mass. 02061; Robert F. McNulty, 153 Stonehenge, Brewster, Mass. 02631

[ * ] Notice: The portion of the term of this patent subsequent to Nov. 10, 2004 has been disclaimed.

[21] Appl. No.: 117,223

[22] Filed: Nov. 5, 1987

Related U.S. Application Data

[63] Continuation-in-part of Ser. No. 892,274, Aug. 4, 1986, Pat. No. 4,706,070.

[51] Int. Cl.[4] ..... G08B 13/14; G08B 21/00

[52] U.S. Cl. ..... 340/568; 340/652; 340/693; 340/984

[58] Field of Search ..... 340/568, 693, 652, 984

[56] References Cited

U.S. PATENT DOCUMENTS

| | | | |
|---|---|---|---|
| 3,696,371 | 10/1972 | Wise | 340/568 |
| 3,742,480 | 6/1973 | Hoecker | 340/568 |
| 3,824,575 | 7/1974 | Rich | 340/984 |
| 4,151,506 | 4/1979 | Schoenmetz | 340/63 |
| 4,250,501 | 2/1981 | Pokrandt | 340/664 |
| 4,274,077 | 6/1977 | Felger | 340/63 |
| 4,327,360 | 4/1982 | Brown | 340/571 |
| 4,329,681 | 5/1982 | Parsons | 340/568 |
| 4,706,070 | 11/1987 | Forti et al. | 340/568 |

*Primary Examiner*—Glen R. Swann, III

*Attorney, Agent, or Firm*—Nixon & Vanderhye

[57] ABSTRACT

A self-contained alarm system for a boat outboard motor connected to a boat transom by clamps is easily retrofit onto an existing boat. A housing of tough non-conductive material (such as polycarbonate) contains a power source (such as a battery) and a signalling device (such as a horn or lights). The housing includes a hub and a pair of arms, which are pivotal with respect to each other about the hub, or the arms can be sliding members, sliding relative to each other. Electrical contacts are provided adjacent the end of one or both of the arms, the contacts engaging clamp pads. If the clamp pads are moved out of operative engagement with the contacts, the battery activates the signal device. A circuit for sensing an open circuit condition may interconnect the signal and battery may be provided, or the contacts may be designed so that a closed circuit actuates the signal.

19 Claims, 2 Drawing Sheets

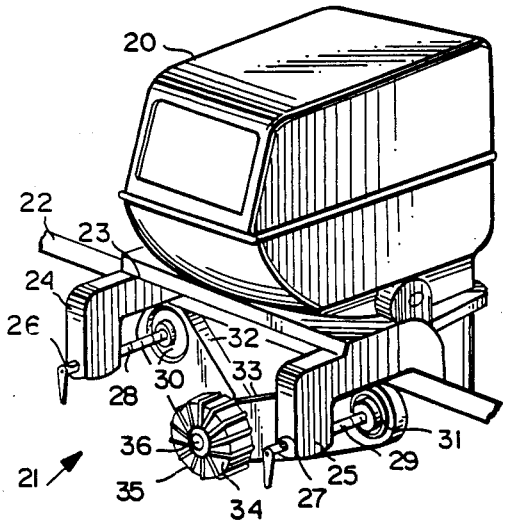
FIG. 1
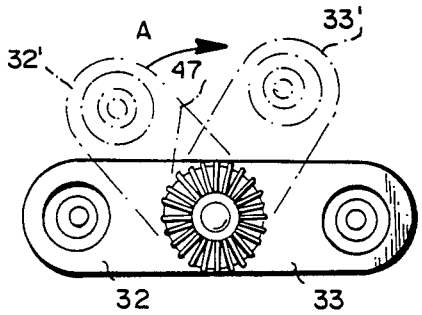
FIG. 3
FIG. 2
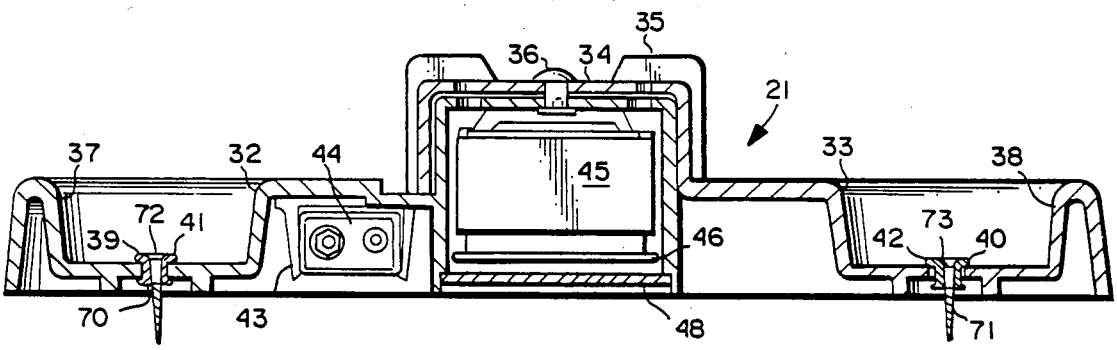
FIG. 4
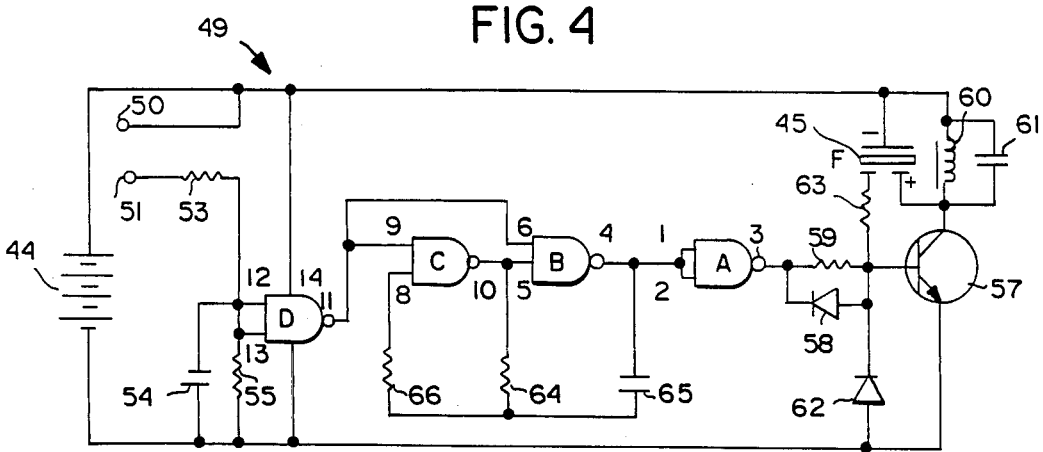

ALARM OR WARNING SYSTEM FOR USE WITH AN OUTBOARD MOTOR

CROSS-REFERENCE TO RELATED APPLICATIONS

This application is a continuation-in-part of application Ser. No. 892,274 filed Aug. 4, 1986, now U.S. Pat. No. 4,706,070, issued Nov. 10, 1987, and the disclosure of which is hereby incorporated by reference herein.

BACKGROUND AND SUMMARY OF THE INVENTION

In many types of pleasure boats, an outboard is connected to a boat transom by clamps. Such motors are vulnerable to theft since they are often left unattended for long periods of time. Additionally, it is possible for the clamps to become loose due to motor vibration or other conditions, which can result in less than optimum transmission of power from the motor to the boat, damage to the motor or boat, or in extreme conditions loss of the motor.

In U.S. Pat. No. 3,696,371, an outboard motor alarm system is disclosed which will result in an alarm sounding if a thief loosens the clamps holding the motor to the transom, or if the clamps are loosened a sufficient amount during use will indicate such looseness. However the system as described in said patent is difficult to install in a boat since the alarm system and power supply are remote from the boat motor clamps, which requires cabling; or in an alternative embodiment a transmitter must be located adjacent the outboard motor, and a receiver adjacent an alarm and power supply remote from the motor.

According to the present invention, an alarm system for a boat outboard motor connected to a boat transom by clamps is provided which positively indicates if theft is attempted, and also senses loosening of the motor, yet may be easily, quickly, simply, and reliably retrofit to an existing boat. According to the present invention there is provided a self-contained alarm system which includes a housing containing a power source and a signalling means, and housing preventing access to the power source and the signalling means. The housing includes contact means for engaging a clamp which connects the motor to the boat transom so that when the clamp is engaged thereby the power source does not actuate the signalling means. However when the contact means is not engaged by a clamp, the power source actuates the signalling means, powered by the power source.

A wide variety of options are available for the details of the interconnection between the housing and the motor clamps. For example in one embodiment the housing includes first and second arms, each with an electrically conductive sensor member mechanically connectable to one of the clamps of the outboard motor. If either of the clamps is mechanically backed off from the electrically conductive sensor member, the electrical resistance between the clamp and the respective sensor increases, causing an "open circuit" type of condition and activating the signalling means through circuitry means also located within the housing. In another embodiment, only one of the clamps is in operative communication with electrically conductive means, bridging a pair of electrical connectors which are operatively connected to the circuitry, signalling, and power device within the housing. In yet another embodiment, the clamp engages a spring pressed plunger so that when the clamp is tight a movable contact bridging a pair of stationary contacts is open, and closes when the clamp is loosened, causing the spring to move the movable bridging contact to its closed position bridging the stationary contacts. In this latter embodiment circuitry means are not necessary.

In both of the last described embodiments, dual sensing structures can be provided so that both the clamps are operatively associated with contacts so that loosening of either of the clamps sounds an alarm, flashes lights, or produces another type of signalling. Also, it the latter two embodiments only a single arm need be provided associated with the housing, and if desired a hub of the housing can be connected to the transom.

It is the primary object of the present invention to provide an easily retrofit self-contained signalling system for a boat outboard motor with all components self-contained, and which is easily retrofit onto existing boats. This and other objects of the invention will become clear from an inspection of the detailed description of the invention and from the appended claims.

BRIEF DESCRIPTION OF THE DRAWINGS

FIG. 1 is a perspective view of an exemplary outboard motor alarm system according to the present invention;

FIG. 2 is a cross-sectional view of the housing of the alarm system of FIG. 1;

FIG. 3 is a top plan view of the housing of the signalling system of FIG. 1 showing in solid and dotted line respective various positions that the arms of the housing may take;

FIG. 4 is a circuit schematic illustrating a form of circuitry that may be utilized with the alarm system according to the invention wherein an open circuit condition is to be sensed;

DETAILED DESCRIPTION OF THE DRAWINGS

Figure 5:
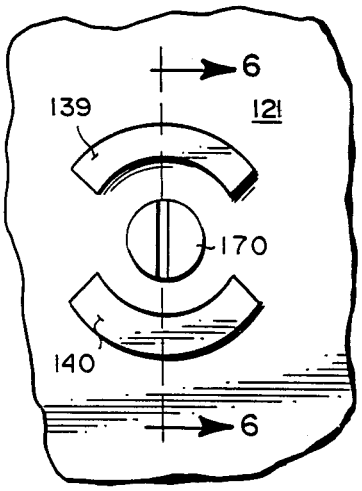
FIG. 5 is a top plan detail view of the clamp engaging the conductors of another embodiment according to the invention.

Referring to FIG. 1 of the drawings an outboard motor 20 mechanically couples an alarm housing 21 to the transom 22 of a boat.

The outboard motor 20 may be of a variety of types and provide a wide range of horsepower to a propeller (not shown). The outboard motor 20, although often heavy and bulky, is considered to be portable. The outboard motor 20 includes a clamping structure typically made up of a cross-member 23 having first and second downwardly angled members 24 and 25, respectively, disposed from either end of the cross-member 23. The cross-member 23 and the angled members 24 and 25 are all typically formed of the same material such as stainless steel. The clamping structure, made up of the cross-member 23 and the first and second angled members 24 and 25 are all typically formed of the same material such as stainless steel. The clamping structure, made up of the cross-member 23 and the first and second angle members 24 and 25, is typically electrically conductive, although the invention is not restricted to electrically conductive elements.

Disposed in the free ends of the first and second angle members 24 and 25 are threaded apertures 26 and 27. Threaded through the apertures 26 and 27 are clamps 28 and 29. The clamps 28 and 29 are typically formed of an electrically conductive material such as aluminum, although they may be non-conductive. At the free end of clamps 28 and 29 are integrally formed pad members 30 and 31, respectively. The pad members 30 and 31 are likewise formed of an electrically conductive material such as aluminum. Thus, an electrical connection is capable of being formed between pad member 30 and pad member 31 through the clamping structure made up of the first and second angled members 24 and 25 and cross-member 23 and clamps 28 and 29.

The alarm housing 21 is formed of a tough polycarbonate material (which is electrically non-conductive) and includes first arm portion 32 and second arm portion 33 pivotally connected to a central hub, pivot portion 34 having a decorative horn housing 35 and a centrally disposed shield member 36.

At the free end of each arm portion 32 and 33 is a first and second cup-shaped depression 37 and 38, respectively, best seen in FIG. 2. The first and second cup-shaped depressions 37 and 38 include first and second electrically conductive sensor members 39 and 40, respectively. The cup-shaped depressions 37 and 38 are of a sufficient depth to require several full turns of the clamps 28 and 29 before the pad members 30 and 31 clear the alarm housing. This assures that the alarm will be activated well prior to the removal of the outboard motor 20 and for a long enough period of time prior to any attempt to destroy or discard (e.g. sink) the alarm unit.

The depth of the cup-shaped depressions 37 and 38 also provides further integrity to the clamping structure by trapping a suddenly loosened clamp, thereby aiding in preventing the accidental loss, in use, of the outboard motor. The sensor or contact members 39 and 40 may each be formed from a rivet and are so shaped to provide sufficient surface area 41 and 42 to assure a good electrical connection with the generally disk-shaped pad members 30 and 31 of clamps 28 and 29. Preferably the sensor members 39, 40 are formed of an electrically conductive corrosion resistant material such as stainless steel.

In a preferred embodiment, best seen when referring to FIG. 2, the sensor members 39 and 40 include apertures or hollow portions 70 and 71, respectively, through which fastening means such as screws 72 and 73 firmly attach the housing 21 to the transom 22 of the boat. Attaching the housing 21 firmly to the transom 22 at sensor members 39 and 40 adds significant strength and integrity to the clamping structure. When the housing 21 is permanently attached to the transom 21, the chance of accidental disengagement of the outboard motor, in use, is significantly lessened. Since the housing 21 is securely attached to the transom 23, even if both clamps are suddenly loosened, the depth of the cup-shaped depressions 37 and 38 would trap the clamps and substantially prevent the outboard motor from disengaging from the transom.

Referring to FIG. 2, the cross-section of the alarm housing 21 is shown with the first and second arm portions 32 and 33 in axial alignment. That is, the centerline distance of sensor members 39 and 40 are at their maximum distance from one another. The housing 21 has a self-contained power source, signalling means, and—where necessary—circuitry means.

A compartment 43 is located inside of the housing 21 and provides the releasable mounting of a power source such as a 9 volt battery 44. The battery 44 may be shielded by compartment 43 and housing 21 in order to prevent the shorting of the terminals of battery 44 when the housing 21 becomes wet. The battery 44 is releasably connected in the compartment 43 to include its terminals in a downstanding position. Further, drain holes may be included in compartment 43 or other appropriate places in housing 21. When the alarm housing 21 is mounted between the clamps 28 and 29 of the outboard motor 20 and the transom 22 of the boat, the battery 44 is inaccessible. The battery 44 is readily accessible for replacement by the consumer through the open back of the alarm unit.

The central pivot portion 34 defines an internal housing for receiving a signalling means 45 for providing an alarm signal when activated. The signalling means 45 is also inaccessibly located when the alarm housing 21 is mounted between the clamps 28 and 29 of the outboard motor 20 and the transom 22 of the boat. Signalling means 45 may take a variety of forms such as a three-terminal piezo-electric horn, light emitting elements, or other types of wave or radiation generators.

Disposed through the housing 21 at the central pivot portion 34 and directly above the horn 45 is shield member 36 which may be in the form of a rivet. The shield member 36 is positioned over the diaphragm portion of the horn 45 in order to substantially prevent puncture of the diaphragm horn through the housing 21 to deter the disarming of the horn 45 during a theft. Rivet 36 also pivotally interconnects arm 33 and hub 34.

Also enclosed in the compartment defined by central pivot hub portion 34, and structurally attached to the horn 45, is circuit means 46. The circuit means 46, which is better described when referring to FIG. 4, may include one or more integrated circuits and be encapsulated or otherwise sealed against corrosive elements. The alarm signal is emitted through a piezo-electric horn, such as made by star co., which emits a 90 Db. intermittent signal when activated. Alternatively, a contactor horn as made by Edwards Company may be utilized. The emitter diaphragm of the horn 45 may include drain holes or vents to allow drainage of moisture which may collect. A cover 48 is provided to further protect the circuit means 46.

Referring to FIG. 3, arm portions 32 and 33 are shown, in solid lines, in their fully extended or axially aligned position. When the arm portions 32 and 33 are pivoted toward each other about an axis through hub 34, such as in the direction of arrow A, they will have a shorter centerline distance such as shown in arm portions 32' and 33' shown in dotted lines. The adjustability of the arm portions 32 and 33 is desirable in order to provide a variety of centerline distances between sensor members 39 and 40 to accommodate the proper alignment with various clamp centerline distances in a variety of outboard motors. Clamp centerline distances typically range from about 4 inches minimum to about 8 inches maximum when fully opened. The arm portions 32 and 33 can be formed with integrally molded abutments or stops such as stop 47, resulting in the minimum centerline distance to limit the travel between arms 32 and 33.

Referring now to FIG. 4, circuitry means 49 is shown for embodiments according to the invention wherein an open circuit condition is sensed. The circuit means has a first control lead 50 and a second control lead 51. The control leads are electrically connected to sensor members, such as sensor members 39 and 40, as shown in FIG. 2. Control lead 50 is electrically connected to the anode of a battery 44, and control lead 51 is electrically connected to the cathode of battery 44 through the series connection of resistor 53 and the parallel connection of capacitor 54 and resistance 55. Resistor 53 and capacitor 54 function as an RC filter in order to remove damaging transients (noise) which may appear at the control leads 50 and 51. Resistor 53 may have a value of 220 K ohms, and capacitor 54 may have the value of 0.1 microfarads.

Inverters A, B, C, and D are preferably formed from an integrated circuit chip such as integrated circuit 4011B, manufactured by Motorolla. The pin numbers 1 through 13 are those pin numbers designated with the chip.

Inverter D, with its dropping resistor 55, having a value such as 2.2M ohms, functions as a high input impedence switch controlling the three-terminal piezo-electric horn 45. When the control leads 50 and 51 are shorted, the output of inverter or gate D is forced low causing the alarm to remain off and in a low quiescent current standby mode. Opening the control leads 50 and 51 allows the input of inverter D to be pulled down by resistor 55 causing the output of inverter D to go high, turning on the modulating oscillator (inverters C and B) and the main piezo driver oscillator (inverter A), to be described subsequently. Resistor 55 also sets the sensitivity of the system. The value of resistor 55 varies directly with the alarm system's ability to tolerate resistive connections in the control leads 50 and 51. The life of battery 44 increases with the resistive value of resistor 55.

Inverters C and B form a free-running multivibrator and are arranged in a C MOS oscillator configuration. They function to provide on-off modulation at a frequency of approximately 10 HZ, making the alarm tone more alerting. The oscillating frequency is determined by the value of resistor 64 and of capacitor 65. Resistor 66 limits the current through protective diodes (not shown) on the input of inverter C as well as reducing the variation in oscillating frequency between units to make the unit independent of supply voltage variations. Resistor 66 is chosen to be at least twice as large as resistor 64. Resistor 64 may have a value of 150K ohms; resistor 66 may have a value of 3.9M ohms; and capacitor 65 may have a value of 0.001 microfarads. Pulling pins 6 and 9 of the oscillator up and down turn the oscillator on and off, respectively. When the oscillator is not enabled, pin 4 remains high, causing pin 3 to remain low.

The base of NPN transistor 57, such as Model 2N3704, is also held low by way of the diode 58, such as Model 1N4454, turning off the driver oscillator. When the modulating oscillator is enabled, pin 3 of inverter A toggles high and low at a 50% duty cycle. During the half cycle pin 3 is a high, the base of transistor 57 is biased on by resistor 59 having a value such as 100 K ohms, with diode 58 remaining off, allowing the driver oscillator to oscillate at the resonant frequency of the piezo-electric transducer 45 (approximately 3 KHZ).

The oscillator driving frequency is kept on resonance by a voltage feedback tab, terminal F on horn 45. The phase relationship of the feedback voltage and the drive voltage on the + input of horn 45 tends to change as the oscillator drifts away from the resonant frequency. The feedback voltage controls the conduction of transistor 57 tending to keep the oscillator at the proper frequency. The parallel connection of inductor 60 and capacitor 61 form a resonant circuit to increase the driving voltage on horn 45 to approximately 80 volts producing a peak sound power output of approximately 90 dbA at 10 feet. The inductor 60 may have a value of 18 microhenrys, and capacitor 61 may have a value of 0.047 microfarads. Diode 62 protects the base of transistor 57 from the damaging effects of negative transients. Resistor 63, connected between the feedback tab, terminal P, and the base of transistor 57 may have a value such as 10K ohms and serves to keep the voltage of the base of transistor 57 in a safe range.

In operation of the FIGS. 1, 2 and 4 embodiment, the outboard motor protection alarm incorporates an integral power supply, signalling means (e.g. noise maker), and trigger, within a tough polycarbonate housing. Power is obtained from a 9 volt battery which is sealed between the rear cavity of the unit and the transom of the boat. The alarm unit weighs approximately 9.5 ounces without the battery. Battery life in the device is approximately equal to its shelf life. An alarm is sounded through a piezo-electric horn. The electronics are sealed against corrosive elements, and the emitter diaphragm of the horn is vented to allow a drainage of moisture which might collect. The alarm is a 90 Db. intermittent signal.

Installation of the alarm is accomplished by simply clamping the alarm's stainless steel contact to the boat with the outboard motor securing clamps. If further integrity to the clamping structure is desired, the entire alarm unit may be also attached directly to the transom of the boat. The unit may be screwed to the transom at a variety of places on the alarm housing such as through the hollow sensor members previously described.

A thin metallic shorting strip (not shown) may be provided to aid in assembly. The shorting strip would be connected between sensor members 39 and 40 during assembly. When the outboard motor 20 is mounted and the clamping structure is tight, the shorting strip may be pulled loose and discarded, thereby arming the alarm unit.

In the FIGS. 1, 2, and 4 embodiment, the contact pads become short circuited when the motor clamps are tightened, thereby creating a circuit continuity through the clamping structure of the motor. Loosening of either clamp will cause a greater circuit resistance. A resistance greater than two meg-ohms will sound the alarm. The high resistance level is used to insure that the motor is clamped tightly to the boat. This feature will not only protect the motor from a security standpoint but also from a safety standpoint, warning of loosening through vibrations or negligence. Adjustability is achieved by rotating the mounting pads about the center of the housing to allow for manufacturer's variations in design and motor size.

Figure 6:
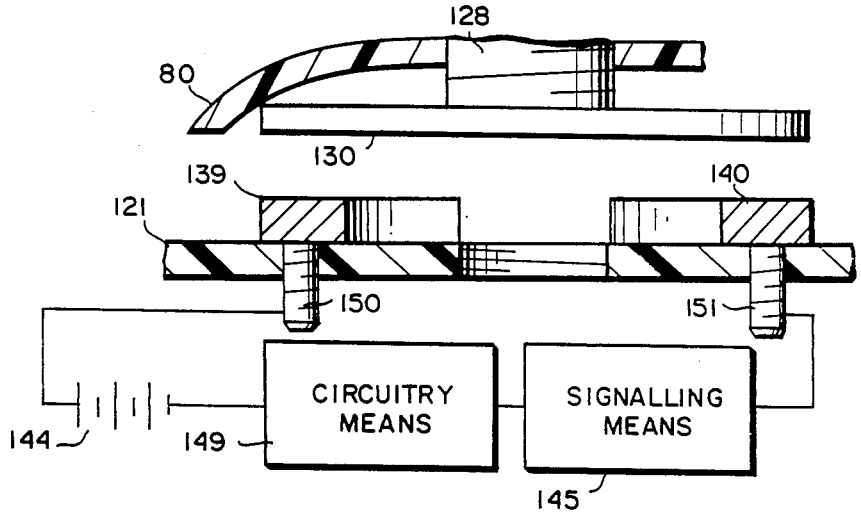
FIG. 6 is a cross-sectional view taken along lines 6—6 of FIG. 5 and also showing the clamp bridging the stationary contact.

There are a wide variety of other forms that the invention can take yet still provide a device which is easily retrofit onto a boat and is self-contained. For example the embodiment illustrated in FIGS. 5 and 6 is substantially identical to the FIGS. 1, 2 and 4 embodiment except that the signalling means can function responsive to the movement of only one of the clamps, and there is no necessity that the clamp screw-threaded elements, mounting structure, or the outboard motor housing be electrically conductive. In the FIGS. 5 and 6 embodiment elements comparable to those in the FIGS. 1, 2, and 4 embodiment are indicated by the same reference numeral only preceded by a "1".

The non-conductive, tough housing 121 may be identical to the housing 21, or alternatively it may have only one "arm" portion if the unit is to responsive to the movement of only one of the clamps. The contacts 139, 140 are spaced from each other, and electrically isolated from each other, and a screw 170 passing through a central portion of the housing 121 between the contacts 139, 140 can assist in holding the housing 121 to the boat transom 22. The pad 130 of the clamp (see FIG. 6) acts as a bridging contact bridging the contacts 139, 140. In this embodiment, only the pad 130 need be conductive, not the screw-threaded portion 128, or any other portion of the clamp mounting structure or the outboard motor housing. If desired, a protective rubber washer 80 or the like may be provided which covers the pad portion 130 of the clamp and restricts access of water or corrosive elements to the clamp pad 130 or contacts 139, 140.

As illustrated in FIG. 6, the terminals 150, 151 connected to the contacts 139, 140 are operatively connected to the battery 144, mounted within housing 121, to signalling means 145 mounted within housing 121, and to and circuitry means 149. The battery, circuitry means, and signalling means may be the same as in the FIGS. 1, 2, and 4 embodiment.

With respect to the FIGS. 5 and 6 embodiment, the other clamp may be merely provided with the pad member thereof directly engaging the transom; or it can engage an arm of the housing identical to the portion illustrated in FIGS. 5 and 6 only without any contacts; or a completely redundant system can be provided wherein another set of contacts (like 139, 140), etc., cooperate with the other clamp.

Figure 7:
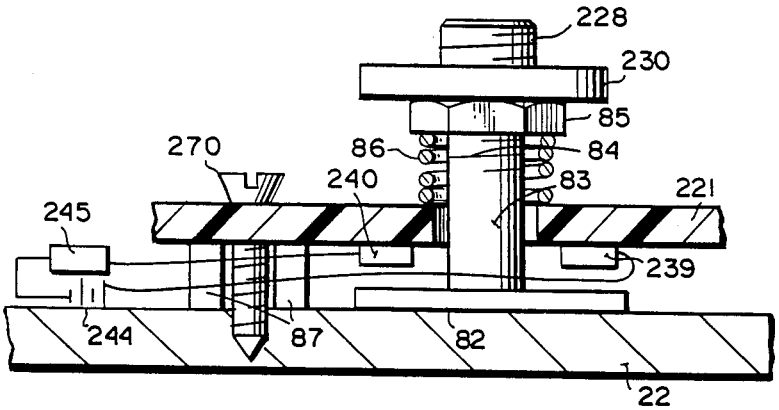
FIG. 7 is a detail view, partly in cross-section and partly in elevation, of yet another embodiment of an alarm according to the invention.

FIG. 7 illustrates another exemplary embodiment within the scope of the invention in which a closed circuit condition results in actuation of the signalling means, rather than an open circuit condition as for the FIGS. 1, 2, 4, 5, and 6 embodiments. In FIG. 7 components equivalent to those in the FIGS. 1, 2, and 4 embodiments are illustrated by the same reference numeral only preceded by a "2".

In the FIG. 7 embodiment, the housing 221 may be identical to the housing 21 in most respects, except that electrically conductive contacts 239, 240 are mounted to the interior of the housing rather than to the exterior thereof. A bridging contact 82 is adapted to bridge the stationary contacts 239, 240. Bridging contact 82 is of electrically conductive material, and is mounted on a plunger 83 which has screw threading 84 and a nut 85 cooperating with the screw threading 84. A stiff compression spring 86 acts between the housing 221 and the nut 85 to bias the bridging contact 82 to the closed position. When the clamp pad 230 is tightened, into engagement with the plunger 83, it compresses the spring 86 and causes the bridging contact 82 to move away from the contacts 239, 240. If desired, spacers, such as plugs of relatively incompressible material 87, may be provided between the housing 221 and the transom 22.

Note that the contacts 239, 240 are connected up to signalling means 245 and the battery 244. In this embodiment there is no necessity for circuitry means since no "open circuit" condition will be sensed, but rather the closing of the contacts 82, 239, 240 will complete the circuit to the signalling means 245. In the FIG. 7 embodiment, as for the FIGS. 5 and 6 embodiment, either only one clamp can have the contact means and sensing means, etc., associated therewith, or two systems can be provided.

It will thus be seen that according to the present invention a self-contained alarm system for a boat outboard motor is provided that may be easily retrofit onto a boat, and contains a power source, signalling means, and all other components necessary for indicating when motor clamps have been loosened either as a result of an attempted theft or loosening as a result of vibration, etc. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and systems.

What is claimed is:

1. A self-contained alarm system for a boat outboard motor connected to a boat transom by clamping means, said system comprising:

a housing containing a power source and a signalling means, said housing preventing access to said power source and signalling means; and said housing including contact means for engaging a clamp of said clamping means, connecting the motor to the boat so that when the clamp is engaged thereby the power source does not actuate the signalling means, but when the clamp does not engage the contact means, said power source operates said signalling means.

2. A system as recited in claim 1 wherein said housing is constructed of a tough electrically non-conductive material.

3. A system as recited in claim 2 wherein said housing comprises a hub portion and a pair of arms, with end portions, extending outwardly from said hub portion and pivotal with respect to each other about an axis through said hub portion so that the spacing between end portions of said arms may be varied.

4. A system as recited in claim 3 wherein said contact means are provided adjacent the end of at least one of said arms.

5. A system as recited in claim 4 wherein said contact means are provided adjacent the ends of both of said arms.

6. A system as recited in claim 5 comprising fasteners connecting said housing to said transom, said fasteners including a fastener associated with each of said contact means and covered by said clamping means so as to prevent access to and removal of said fastener except when said clamping means are withdrawn from contact with said contact means.

7. A system as recited in claim 6 wherein said housing arms comprise means defining depressions surrounding said contact means, said contact means being at the bottom of said depression, said depression for receipt of a pad associated with the clamp of said clamping means which engages said contact means, and for preventing accidental loss of the motor.

8. A system as recited in claim 3 wherein said signalling means is mounted within said hub and further comprising a shield member associated with said housing for facilitating the prevention of access to said signalling means mounted within said hub.

9. A system as recited in claim 8 wherein said shield member comprises a rivet, and wherein said rivet also comprises means for interconnecting said hub and arms for allowing relative pivotal movement of said arms with respect to said hub.

10. A system as recited in claim 8 wherein circuitry means for sensing an open circuit condition and for actuating said signalling means, powered by said power means, it also mounted in said hub, with said signalling means.

11. A system as recited in claim 2 wherein said housing is of polycarbonate.

12. A system as recited in claim 1 further comprising fasteners connecting said housing to said transom, at least one of said fasteners being inaccessible except upon disconnection of said clamping means.

13. A system as recited in claim 1 wherein said housing comprises means defining depressions surrounding said contact means, said contact means being at the bottom of said depression, said depression for receipt of a pad associated with the clamp of said clamping means which engages said contact means, and for preventing accidental loss of the motor.

14. A system as recited in claim 1 further comprising circuitry means mounted within said housing for sensing an open circuit conditions and for actuating said signalling means, powered by said power source, when said clamping means is moved out of operative association with said contact means.

15. A system as recited in claim 14 wherein said clamping means comprises first and second clamps, and wherein said housing includes first and second contact means, one for engagement by each of said first and second clamps.

16. A system as recited in claim 1 wherein said clamping means comprises first and second clamps, and wherein said housing includes first and second contact means, one for engagement by each of said first and second clamps.

17. A self-contained alarm system for a boat outboard motor connected to a boat transom by clamping means, said system comprising:

a housing having a central hub portion and first and second arm portions, said arm portions mounted for pivotal movement relative to each other about an axis through said hub so that the spacing between the ends of said arms may be varied;

means associated with the ends of said arms for operatively engaging said clamping means;

a power source and signalling means mounted within said housing, said housing preventing access to said power source and signalling means; and means for effecting actuation of said signalling means by said power source if said clamping means is moved away from operative association with said transom; and fastening means for connecting said housing to said transom.

18. A system as recited in claim 17 wherein said clamping means comprises first and second clamps each with clamp pads at an end thereof; and wherein said fastening means comprises first and second fasteners adjacent the ends of said first and second arms, said fasteners covered by said clamp pads when in use so that access to said fasteners is not possible except by moving said clamp means out of contact therewith.

19. A system as recited in claim 17 wherein said signalling means is mounted within said hub, and wherein said power source comprises a battery mounted within one of said arms, adjacent said hub.

* * * * *